US009153161B1

(12) United States Patent
Byun

(10) Patent No.: US 9,153,161 B1
(45) Date of Patent: Oct. 6, 2015

(54) TIMING CONTROLLER AND DISPLAY DEVICE

(71) Applicant: LG DISPLAY CO., LTD., Seoul (KR)

(72) Inventor: SeogGyu Byun, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/558,233

(22) Filed: Dec. 2, 2014

(30) Foreign Application Priority Data

Aug. 7, 2014 (KR) ..... 10-2014-0101880

(51) Int. Cl.
*G09G 3/20* (2006.01)

(52) U.S. Cl.
CPC ..... *G09G 3/2018* (2013.01); *G09G 2310/08* (2013.01); *G09G 2320/0257* (2013.01)

(58) Field of Classification Search
CPC ..... G09G 3/3648; G09G 2320/0257; G09G 2320/0233
USPC ..... 345/36–39, 55, 60–63, 76–83, 87–92, 345/690; 315/169.1, 169.3
See application file for complete search history.

(56) References Cited

U.S. PATENT DOCUMENTS

| | | | | |
|---|---|---|---|---|
| 7,466,340 | B1 * | 12/2008 | Herz | 348/173 |
| 2002/0130892 | A1 * | 9/2002 | Holtslag | 345/690 |
| 2003/0231146 | A1 * | 12/2003 | Lee et al. | 345/60 |
| 2004/0251842 | A1 * | 12/2004 | Kubota et al. | 315/169.3 |
| 2005/0140587 | A1 * | 6/2005 | Cho | 345/63 |
| 2005/0212726 | A1 * | 9/2005 | Namba et al. | 345/63 |
| 2006/0055335 | A1 * | 3/2006 | Shingai et al. | 315/169.3 |
| 2010/0053039 | A1 * | 3/2010 | Park et al. | 345/76 |
| 2010/0060554 | A1 * | 3/2010 | Koh et al. | 345/77 |
| 2010/0097413 | A1 * | 4/2010 | Matsumoto | 345/691 |
| 2011/0285712 | A1 * | 11/2011 | Arai et al. | 345/426 |

* cited by examiner

*Primary Examiner* — Hong Zhou
(74) *Attorney, Agent, or Firm* — Birch, Stewart, Kolasch & Birch, LLP

(57) ABSTRACT

A timing controller for a display device, the timing controller including a luminance control area detecting device configured to analyze image data and detect at least one candidate area of an active area of a display panel in the display device satisfying a luminance control area condition as a luminance control area; a luminance control reference setting device configured to set luminance control reference information on the luminance control area, based on an input luminance of the at least one candidate area; and a luminance controlling device configured to control a luminance of the luminance control area, based on the luminance control reference information.

9 Claims, 10 Drawing Sheets

TIMING CONTROLLER AND DISPLAY DEVICE

CROSS-REFERENCE TO RELATED APPLICATION

This application claims priority from and the benefit under 35 U.S.C. §119(a) of Korean Patent Application No. 10-2014-0101880, filed on Aug. 7, 2014, which is hereby incorporated by reference for all purposes as if fully set forth herein.

BACKGROUND OF THE INVENTION

1. Field of the Invention

The present invention relates to a timing controller and a display device.

2. Description of the Related Art

Display devices including Liquid Crystal Display (LCD) devices, Plasma Display Panels (PDP) devices, and Organic Light Emitting Display (OLED) devices in related art have an afterimage phenomenon in which a previous image is shown after an image. The image, which is also referred to as an object in the present specification, is displayed on a screen. But, an afterimage phenomenon results from a disappearance of the image and causes a degradation of image quality. When a condition of a circuit device (e.g., a transistor or an organic light emitting diode) in a pixel of the display device is degraded, a more critical or persistent afterimage phenomenon may occur.

SUMMARY OF THE INVENTION

An aspect of the present invention is to improve image quality by effectively preventing an afterimage phenomenon. The afterimage phenomenon can be prevented by processing differential afterimage prevention in each area where the afterimage may occur. In addition, another aspect of the present invention is to improve image quality by effectively preventing an afterimage phenomenon through an adaptive luminance control. In addition, another aspect of the present invention is to adaptively provide differential luminance control using various luminance control reference information.

The present invention can improve image quality by effectively preventing an afterimage phenomenon.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE EXEMPLARY EMBODIMENTS

Figure 1:
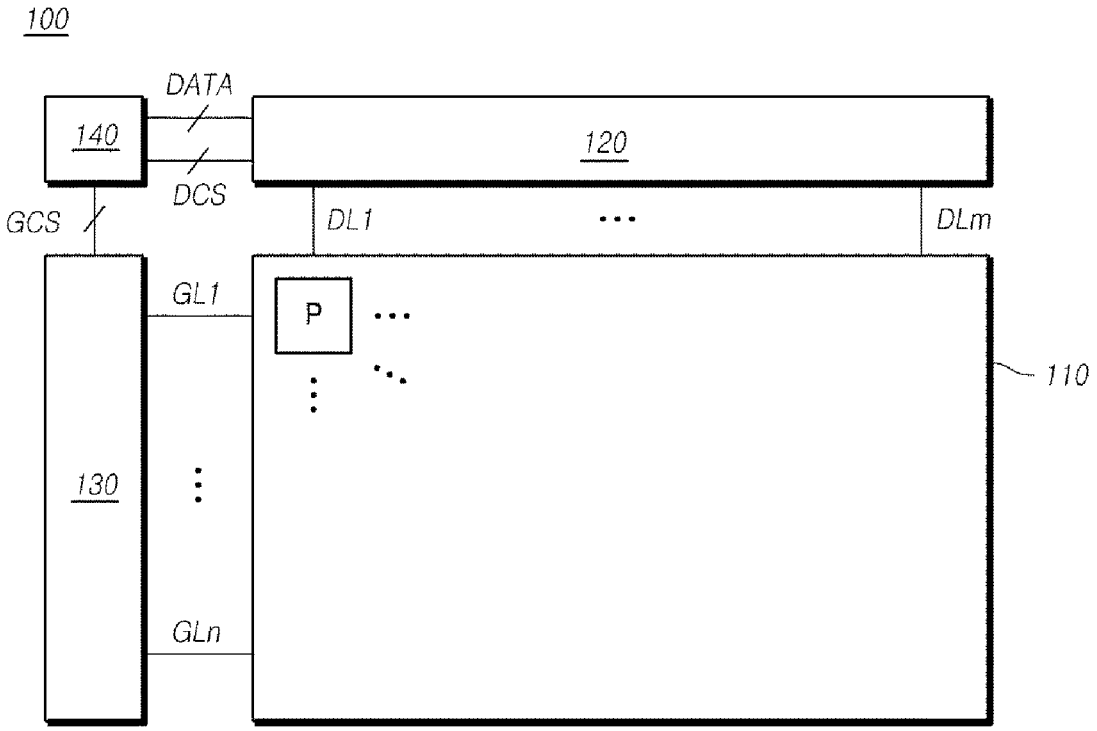
FIG. 1 is a schematic system configuration view of a display device according to an embodiment of the invention.

Hereinafter, embodiments of the present invention will be described with reference to the accompanying drawings. In the following description, the same elements will be designated by the same reference numerals although they are shown in different drawings. Further, in the following description of the present invention, a detailed description of known functions and configurations incorporated herein will be omitted to make the subject matter of the present invention more clear.

In addition, terms, such as first, second, A, B, (a), (b) or the like may be used herein when describing components of the present invention. Each of these terms is not used to define an essence, order or sequence of a corresponding component but used merely to distinguish the corresponding component from other components. Descriptions in the present specification including a certain structural element that "is connected to", "is coupled to", or "is in contact with" another structural element, should be interpreted to also include a certain structural element that may "be connected to", "be coupled to", or "be in contact with" other structural elements, or a certain structural element that is directly connected to or is in direct contact with another structural element.

FIG. 1 is a schematic system configuration view of a display device 100 according to an embodiment of the invention.

The display device 100 includes a display panel 110 including m (m is a natural number) data lines DL1, . . . , and DLm and n (n is a natural number) gate lines GL1, . . . , and GLn, a data drive unit 120 driving the m data lines DL1, . . . , and DLm, a gate drive unit 130 sequentially driving the n gate lines GL1, . . . , and GLn, and a timing controller 140 controlling the data drive unit 120 and the gate drive unit 130.

In the display panel 110, a pixel P is formed in each point where the m data lines DL1, . . . , and DLm and the n gate lines GL1, . . . , and GLn intersect. Each pixel P includes a circuit device such as a transistor, a capacitor, and the like. For example, when the display panel 110 is an organic light emitting diode display panel, an organic light emitting diode, two or more transistors, at least one capacitor, and the like may be formed in each of the pixels.

The circuit device formed in each of the pixels may be degraded due to various factors, and thus an afterimage phenomenon, which is an object to be prevented in the present embodiments, may be deepened.

The timing controller 140 starts a scan according to timing implemented in each frame, converts image data input from an interface in correspondence to a data signal form used by the data drive unit 120, outputs the converted image data Data, and controls a driving of data at a proper time in correspondence with the scan. The timing controller 140 may output various control signals such as a Data Control Signal (DCS), a Gate Control Signal (GCS), and the like, to control the data drive unit 120 and the gate drive unit 130.

The gate drive unit 130 sequentially provides a scan signal of an on or off voltage to the n gate lines GL1, . . . , and GLn according to the control of the timing controller 140 to drive the n gate lines GL1, . . . , and GLn. The gate drive unit 130 may be positioned on only one side of the display panel 110 or may be divided into two units and positioned on both sides of the display panel 110, depending on a driving scheme of the gate drive unit 130. In addition, the gate drive unit 130 may include a plurality of gate drive integrated circuits. The plurality of gate drive integrated circuits may be connected to a bonding pad of the display panel 110 through a Tape Automated Bonding (TAB) method or a Chip On Glass (COG) method, or implemented in a Gate In Panel (GIP) type and directly formed in the display panel 110. The plurality of gate drive integrated circuits may be integrated and formed in the display panel 110.

The data drive unit 120 can store the input image data Data in a memory, convert the corresponding image data Data into a data voltage Vdata of an analog form, and provide the data voltage Vdata to the m data lines DL1, . . . , and DLm to drive the m data lines DL1, . . . , and DLm, when a specific gate line is activated, according to the control of the timing controller 140.

The data drive unit 120 may include a plurality of data drive integrated circuits (or source drive integrated circuits). The plurality of data drive integrated circuits may be connected to a bonding pad of the display panel through the TAB method or the COG method or directly formed in the display panel 110. The plurality of data drive integrated circuits may be integrated and formed in the display panel 110.

Meanwhile, the display device 100 may prevent an afterimage of an image (i.e., an object), which may occur since the image is displayed in a fixed position during a long time, through an adaptive luminance control. According to the adaptive luminance control, when an object is consistently displayed in the fixed position during a predetermined time (e.g., several frame periods), a luminance of the object may be controlled and changed (for preventing the afterimage of the object displayed on the fixed position for a long time by removing the afterimage or fading the afterimage such that the afterimage is invisible to the naked eye although the afterimage is present).

In addition, according to the adaptive luminance control, in a case of two different images, luminance change levels (e.g., a target minimum luminance or a maximum luminance reduction width, described below) or speeds (e.g., a luminance control time or a luminance reduction slope, described below) of each of the images may be different.

The timing controller 140 may provide afterimage prevention by analyzing image data of each frame to detect a partial area (i.e., a candidate area) satisfying a luminance control area condition as "Luminance Control Area (LCA)", set "luminance control reference information (e.g., the target minimum luminance and the like)" for the area detected as the luminance control area, based on the "Input Luminance (Lin)" of the area detected as the luminance control area, control the luminance of the area detected as the luminance control area, based on the luminance control reference information, and output the image data Data compensated according to the controlled luminance.

The data drive unit 120 may receive the compensated image data Data from the timing controller 140, convert the data voltage of the compensated image data Data, and output the data voltage to at least one data line corresponding to the area detected as the luminance control area (i.e., a block that includes one or more pixel areas). The luminance control area may mean an area where the afterimage may occur, an area where the same object is displayed on the fixed position for a long time, or occasionally, the object itself displayed on the fixed position for a long time.

The afterimage prevention function may prevent the afterimage in which the object is continuously shown after the object is consistently displayed on the fixed position during a predetermined time and the object disappears. The luminance control reference information such as the target minimum luminance and the like are individually set for each area detected as the luminance control area (corresponding to the area where the afterimage may occur), and the luminance for the areas detected as the luminance control areas are individually controlled based on the setting, thereby preventing the individual afterimage. Therefore, image quality may be remarkably improved.

The display device 100 may be a Liquid Cristal Display (LCD) device, a Plasma Display Panel (PDP) device, or an Organic Light Emitting Diode (OLED) display device.

Figure 2:
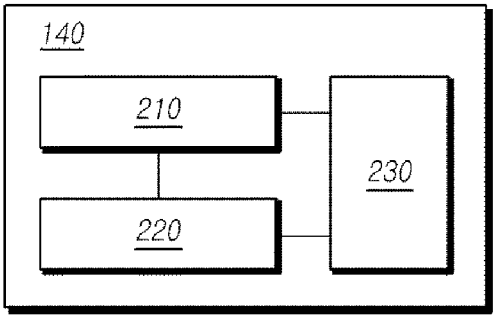
FIG. 2 is a block diagram of a timing controller of the a display device according to an embodiment of the invention.

Next, FIG. 2 is a block diagram of the timing controller 140 in the display device 100 according to an embodiment of the invention. The timing controller 140 of the display device 100 according to an embodiment of the invention includes a luminance control area detecting unit 210, a luminance control reference setting unit 220, or a luminance controlling unit 230.

The luminance control area detecting unit 210 analyzes the image data of each frame to detect the area satisfying the luminance control area condition as the luminance control area.

The luminance control reference setting unit 220 sets the luminance control reference information on the area detected as the luminance control area, based on the input luminance of the area detected as the luminance control area.

The luminance controlling unit 230 may control the luminance of the area detected as the luminance control area, based on the luminance control reference information, and output the image data compensated according to the controlled luminance of the area detected as the luminance control area.

The adaptive luminance control of the timing controller 140 may prevent the afterimage in which the object is continuously shown together with another image, even after the same object is consistently displayed on the fixed position during a predetermined time and disappears. Even when afterimage generation levels of each area detected as the luminance control area corresponding to the area where the afterimage may occur are different, the afterimage may be individually prevented for each area detected as the luminance control area. Therefore, image quality may be remarkably improved.

Here, the afterimage generation level may be different according to, for example, the level of the input luminance of the corresponding area, or the difference between the luminance during the presence of the afterimage and the luminance during the absence of the afterimage.

Figure 3:
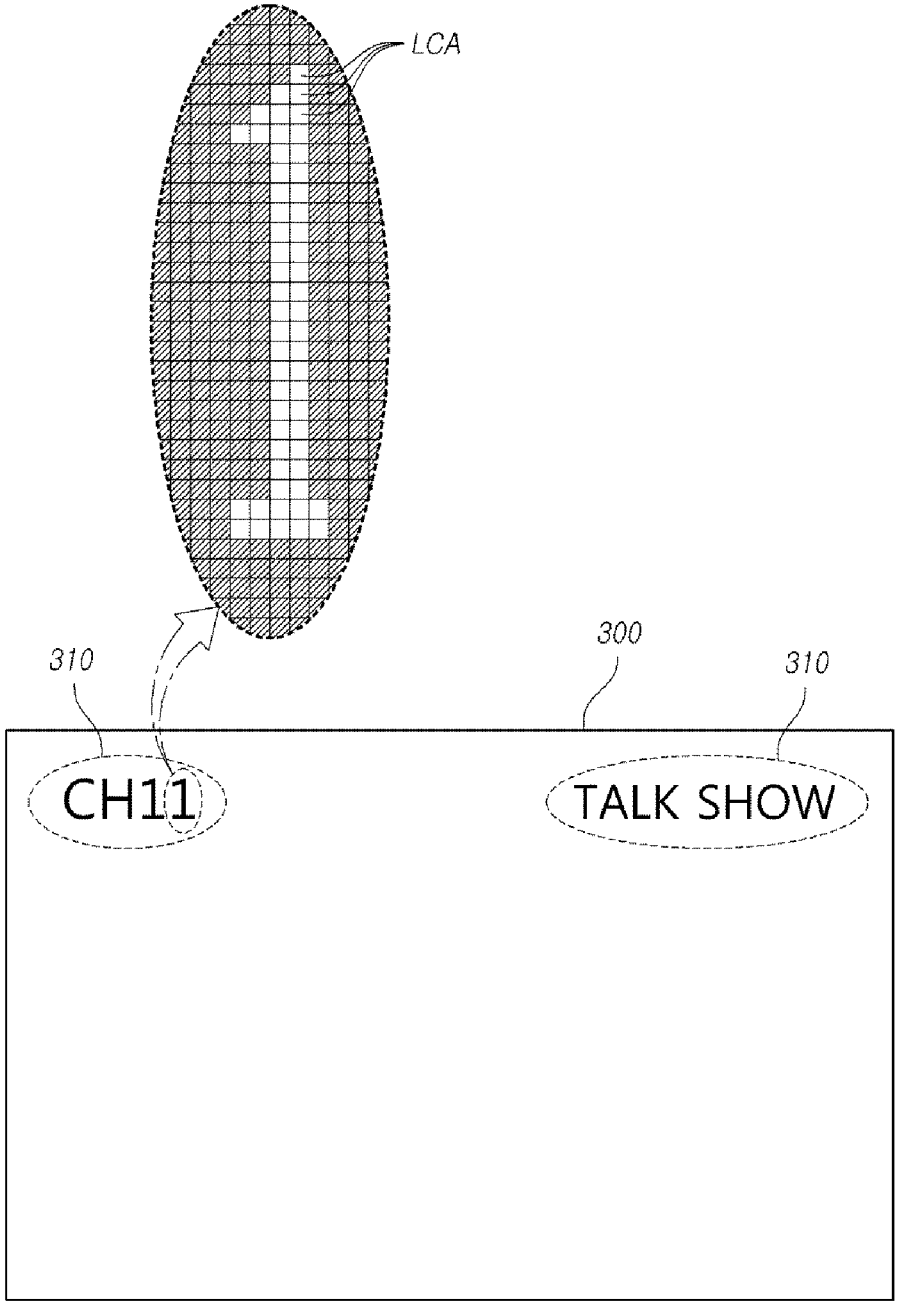
FIGS. 3 and 4 illustrate a detection function of a Luminance Control Area (LCA) of the display device according to an embodiment of the invention.
Figure 4:
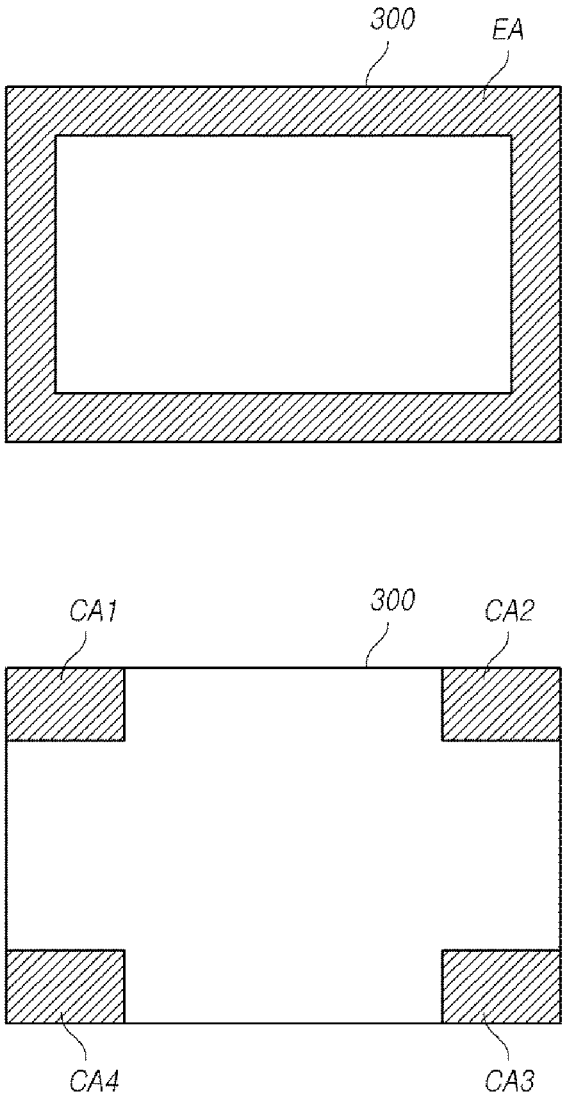

Next, FIGS. 3 and 4 illustrate a luminance control area detecting function, a luminance control reference information setting function and a luminance controlling function performed by the respective luminance control area detecting unit 210, the luminance control reference setting unit 220 and the luminance controlling unit 230 included in the timing controller 140. An object is displayed on the screen (refer to FIG. 3). An image data analysis range is used for detecting the luminance control area (refer to FIG. 4).

The luminance control area detecting unit 210 detects an area (i.e., luminance control area satisfying the luminance control area condition) where the input luminance is maintained within a predetermined luminance range in a predetermined time through the analysis of the image data of each frame input from an external interface. That is, when there is an area where the input luminance is not changed or slightly changed even when the input image is changed in the fixed position for a long time, the luminance control area detecting unit 210 detects this area as the luminance control area satisfying the luminance control area condition. The luminance control area may be easily and quickly detected by analyzing the input image data and detecting the luminance control area based on the input luminance.

The area detected as the Luminance Control Area (LCA) by the luminance control area detecting unit 210 may be the object 310 itself consistently displayed on the fixed position during a predetermined time or include at least one pixel area for consistently displaying the same object 310 on the fixed position during a predetermined time (refer to FIG. 3).

Objects 310 of words marked "TALK SHOW" and "CH11" are displayed on an upper right and an upper left of a screen 300, respectively (refer to FIG. 3). Here, the "TALK SHOW" and "CH11" may be the object, or each of the "T", "A", "L", "K", "C", "H", "1" and "1" may be the object. In an enlarged view of a part displaying the "1" in the words marked "CH11", a plurality of areas brighter than the periphery thereof are detected as the Luminance Control Area (LCA) (refer to FIG. 3).

The afterimage due to the object (e.g., an image for a logo, date information, time information, weather information, channel information, content-related information, broadcast program-related information, or subtitle) displayed on the fixed position for a long time may be prevented, and thus image quality degradation owing to the afterimage may be improved. In other words, the object may be any object which is not changed during each frame and displayed on the fixed position, and thus is able to occur as the afterimage. Because the displaying of the image on the fixed position for a long time may be prevented, the image quality may be improved.

In addition, the object may be displayed on a predetermined position in a whole screen, but the object may be displayed on a limited position (e.g., an edge area or a corner area) hardly disturbing a viewing of a main image displayed on the screen. Therefore, the luminance control area detecting unit 210 may detect the luminance control area by analyzing partial image data corresponding to a partial area (i.e., a candidate area) of a predetermine ratio in the whole screen, in consideration of an area where the object may be displayed.

As described above, a range of the image data analysis needed in detecting the luminance control area is limited, and the analysis amount and analysis time required in the image data analysis may be remarkably reduced, and thus a high speed of detection of the luminance control area is possible.

Such a high speed of detection of the luminance control area enables a proper timing of luminance control for the luminance control area where a possibility of the afterimage is high. Therefore, the afterimage which may occur due to a late detection of the luminance control area may be prevented.

The partial area corresponding to the image data analysis range may include, for example, an Edge Area (EA) or at least one of Corner Areas (CAs) CA1, CA2, CA3 and CA4 in the whole screen 300 (refer to FIG. 4), in consideration of the area where the object may be displayed. Here, the edge area EA and the corner area CA are the areas where the image data analysis is performed.

To detect the luminance control area, the image data analysis is performed in only the limited range of the edge area or the at least one of the corner areas, and thus the analysis amount and analysis time required in the image data analysis may be more effectively reduced, while maintaining the detection accuracy of the luminance control area.

Next, FIGS. 5 to 8 illustrate the luminance control reference information setting function of the luminance control reference setting unit 220. Control reference information is used for the adaptive luminance control of the display device 100 according to an embodiment of the present invention (refer to FIGS. 5 to 8). A setting scheme of the luminance control reference information is used for the adaptive luminance control of the display device 100 according to an embodiment of the present invention (refer to FIGS. 6 to 8).

After the luminance control area is detected by the luminance control area detecting unit 210, to control the luminance of the area detected as the luminance control area, the luminance control reference setting unit 220 sets the reference information for the luminance control.

Figure 5:
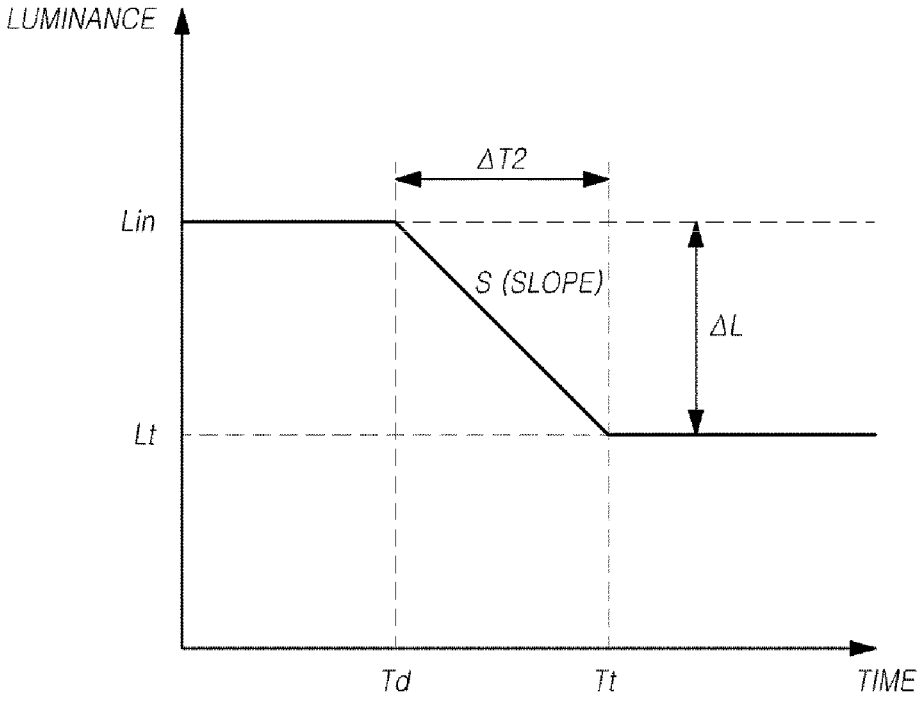
FIG. 5 illustrates luminance control reference information for an adaptive luminance control of the display device according to an embodiment of the invention.

Referring to FIG. 5, the luminance control reference information set by the luminance control reference setting unit 220 includes, for example, the input luminance Lin, the target minimum luminance Lt which is a limit of the luminance control of a corresponding area and/or the maximum luminance reduction width ΔL. Here, the target minimum luminance Lt may be information determined when the input luminance Lin and the maximum luminance reduction width ΔL is determined.

In addition, the luminance control reference information may further include the luminance reduction slope S (here, S is an absolute value) or the luminance control time ΔT which can define a luminance change speed (i.e., luminance control speed) from the input luminance Lin to the target minimum luminance Lt.

The luminance control reference setting unit 220 may check the input luminance Lin from input data, and set the target minimum luminance Lt corresponding to a luminance which is possible to be controlled as low as possible from the checked input luminance Lin, or the maximum luminance reduction width ΔL which is possible to be controlled as low as possible from the checked input luminance Lin, for the luminance control area detected by the luminance control area detecting unit 210 (refer to FIG. 5).

In addition, to define the luminance control speed, in the reduction of the luminance for the area detected as the luminance control area, from the input luminance Lin to the target minimum luminance Lt, or define the luminance control speed, in the reduction of the luminance for the area detected as the luminance control area, from the input luminance Lin to the maximum luminance reduction width ΔL, the luminance control reference setting unit 220 may set the luminance reduction slope S or the luminance control time ΔT (here, $\Delta T = Tt - Td$), according to the input luminance Lin of the area detected as the luminance control area.

The "Td" is the time point when the luminance control is started, after the luminance control area detection time point or after the luminance control area is detected and all pieces of the luminance control reference information are set (refer to FIG. 5). The "Tt" is the time when the luminance of the area detected as the luminance control area becomes the required target minimum luminance Lt or when the luminance of the area detected as the luminance control area lowers by the required maximum luminance reduction width ΔL, according to the luminance control.

Figure 6:
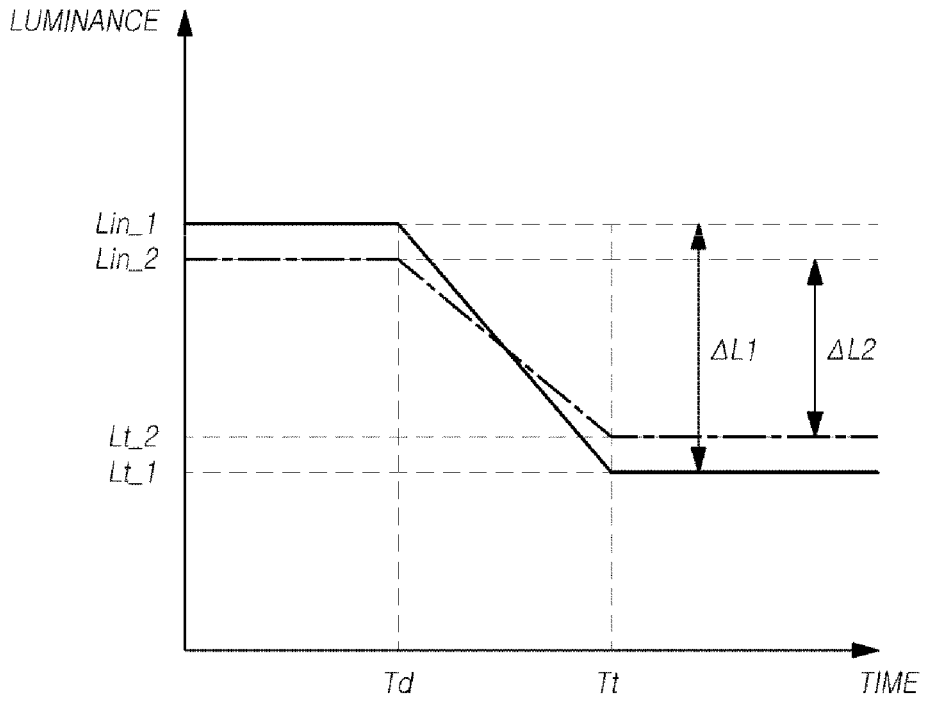
FIGS. 6 to 8 illustrate a setting scheme of the luminance control reference information for the adaptive luminance control of the display device according to an embodiment of the invention.

Referring to FIG. 6, the luminance control reference setting unit 220, most basically, may check the input luminance Lin of the luminance control area, which is detected by the luminance control area detecting unit 210, from the image data, and differentially set the target minimum luminance Lt or the maximum luminance reduction width ΔL for the area detected as the luminance control area, according to the checked input luminance Lin.

Because the target minimum luminance Lt is set for each area detected as the luminance control area, differentially and individually, an individual and differential luminance control may be possible. Therefore, the afterimage may be prevented in correspondence with the area detected as the luminance control area, and thus image quality may be improved.

For example, in differentially and individually setting the target minimum luminance Lt of the area detected as the luminance control area according to the input luminance Lin of the area detected as the luminance control area, the luminance control reference setting unit 220 may set the target minimum luminance Lt to a low luminance Lt_1 or set the maximum luminance reduction width ΔL to a big reduction width ΔL1, as the input luminance Lin of the area detected as the luminance control area is a high luminance (i.e. bright luminance) Lin_1 (refer to FIG. 6).

In addition, in differentially and individually setting the target minimum luminance Lt of the area detected as the luminance control area according to the input luminance Lin of the area detected as the luminance control area, the luminance control reference setting unit 220 may set the target minimum luminance Lt to a high luminance Lt_2 or set the maximum luminance reduction width ΔL to a small reduction width ΔL2, as the input luminance Lin of the area detected as the luminance control area is a low luminance (i.e. dark luminance) Lin_2.

The "Td" is the time point when the luminance control is started, after the luminance control area detection time point or after the luminance control area is detected and all pieces of the luminance control reference information are set (refer to FIG. 6). The "Tt" is the time when the luminance of the area detected as the luminance control area becomes the required target minimum luminance Lt or when the luminance of the area detected as the luminance control area is lowered by the required maximum luminance reduction width ΔL, according to the luminance control.

Due to the differential setting of the target minimum luminance Lt and/or the maximum luminance reduction width ΔL, there are a high risk area and a low risk area. The high risk area is an area where the afterimage may occur more critically, and the low risk area is an area where the afterimage occurs although less critically compared to the high risk area. The luminance control reference setting unit 220 may lower the target minimum luminance Lt for the high risk area compared to that of the low risk area, or set the maximum luminance reduction width ΔL such that the maximum luminance reduction width ΔL for the high risk area is higher than that of the low risk area.

Here, the level of the afterimage means the level of the afterimage seen by the naked eye. For example, the higher the luminance difference between the presence and the absence of the afterimage, the more critical the afterimage may be. In addition, the higher the difference between the input luminance and the actually shown luminance, the more critical the afterimage may be. In general, when the input luminance Lin is high, that is, the bright luminance, the possibility of the critical afterimage may be high.

As described above, because the target minimum luminance Lt is set in inverse proportion to the input luminance Lin or the maximum luminance reduction width ΔL is set in proportion to the input luminance Lin, the adaptive and differential luminance control is processed in correspondence to each of the high risk area where the afterimage may be more critical and the low risk area where the after image may be less critical compared to the high risk area. Thus, the afterimage may be effectively prevented.

In the case of the high risk area where the more critical afterimage may occur, because the target minimum luminance Lt is set to be comparatively low or the maximum luminance reduction width ΔL is set to be high, the luminance control is not insufficient, and thus the afterimage prevention may be processed completely. In the case of the low risk area where the less critical afterimage may occur compared to the high risk area although the afterimage occurs, because the target minimum luminance Lt is set to be comparatively high or the maximum luminance reduction width ΔL is set to be low, unnecessary luminance reduction may be prevented, and thus unnecessary image quality degradation may be prevented.

The luminance control reference setting unit 220 may further set the "luminance control time ΔT" which is the factor of the luminance control speed, as the luminance control reference information, according to the input luminance Lin of the area detected as the luminance control area.

Because the luminance control time ΔT is further set differentially according to each area detected as the luminance control area, in addition to the target minimum luminance Lt or the maximum luminance reduction width ΔL related to the final limit of the luminance control (as the luminance control reference information for the differential luminance control), the luminance control speed may be controlled adaptively and differentially. Thus, the afterimage may be effectively prevented.

Figure 7:
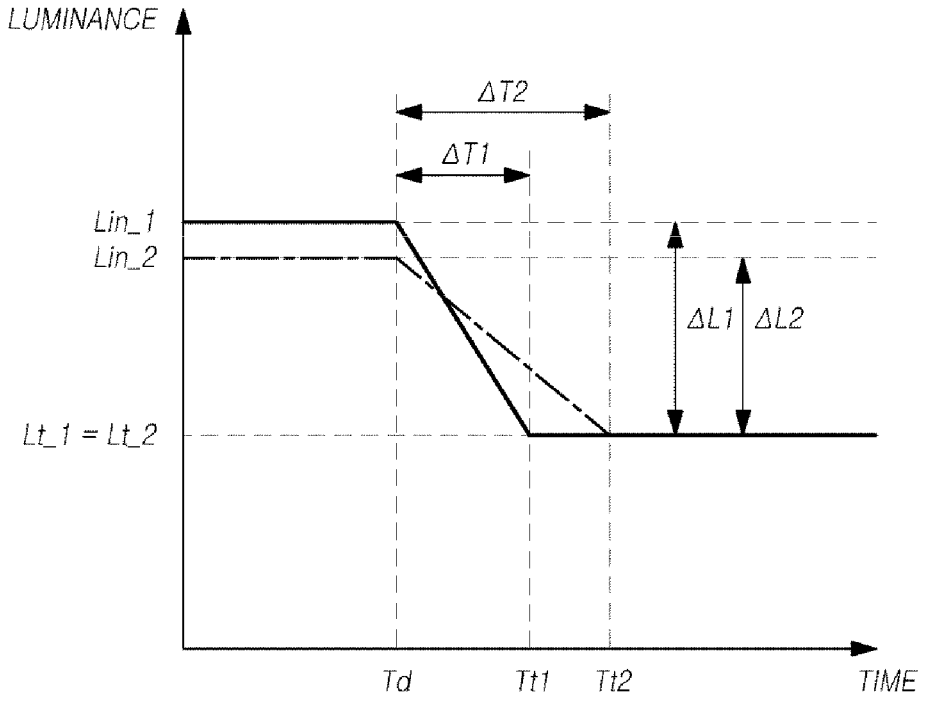

Referring to FIG. 7, the luminance control reference setting unit 220 may set the luminance control time ΔT as a short time ΔT1 (here, Δ T1=Tt1−Td) when the input luminance Lin of the area detected as the luminance control area is the high luminance Lin_1, and set the luminance control time ΔT as a long time ΔT2 (here, ΔT2=Tt2−Td) when the input luminance Lin of the area detected as the luminance control area is the low luminance Lin_2.

The "Td" is the time point when the luminance control is started, after the luminance control area detection time point or after the luminance control area is detected and all pieces of the luminance control reference information are set (refer to FIG. 7). The "Tt1" and "Tt2" are the times when the luminance of the area detected as the luminance control area becomes the required target minimum luminance Lt or when the luminance of the area detected as the luminance control area lowers by the required maximum luminance reduction width Δ L, according to the luminance control.

In setting the luminance control time ΔT differentially in correspondence with each area detected as the luminance control area, when the area detected as the luminance control area is the high luminance Lin_1, that is, when the possibility of the critical afterimage is high in the area detected as the luminance control area, the luminance control time ΔT is set to be short, and thus the luminance control may be faster. The possibility of the afterimage may be reduced according to the fast luminance control.

The luminance control reference setting unit 220 may set the luminance reduction slope which is the factor of the luminance control speed, according to the input luminance Lin of the area detected as the luminance control area. Because the luminance reduction slope S is further set differentially according to each area detected as the luminance control area, in addition to the target minimum luminance Lt or the maximum luminance reduction width ΔL related to the final limit of the luminance control (as the luminance control reference information for the differential luminance control), the luminance control speed may be controlled adaptively and differentially. Thus, the afterimage may be effectively prevented.

Figure 8:
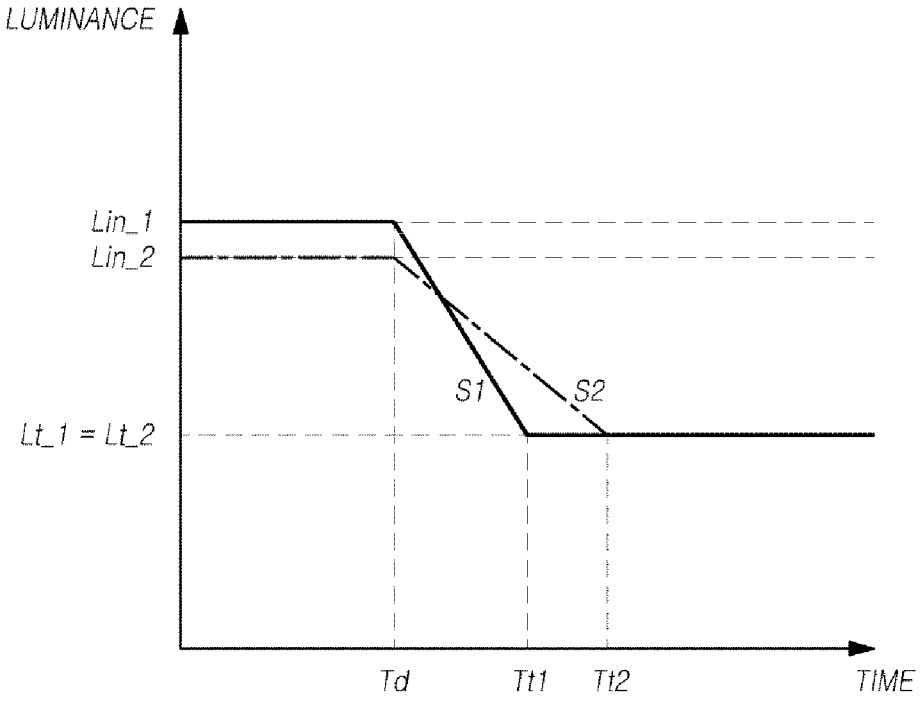

Referring to FIG. 8, the luminance control reference setting unit 220 may set the luminance reduction slope S as a large slope S1 when the input luminance Lin of the area detected as the luminance control area is the high luminance Lin_1, and set the luminance reduction slope S as a small slope S2 when the input luminance Lin of the area detected as the luminance control area is the low luminance Lin_2.

In setting the luminance reduction slope differentially in correspondence with each area detected as the luminance control area, when the area detected as the luminance control area is the high luminance Lin_1 (i.e., when the possibility of the critical afterimage is high in the area detected as the luminance control area), the luminance reduction slope S is set to be steep. Thus, the luminance control may be faster. The possibility of the afterimage may be reduced according to the fast luminance control.

To control the luminance control speed, in setting the luminance control time ΔT and the luminance reduction slope S, the luminance control time ΔT is set to be short or the luminance reduction slope S is set to be steep, when the input luminance Lin of the each area detected as the luminance control area is the high luminance (i.e., the bright luminance). Thus, the luminance control speed is faster. But, to reduce sense of difference in image quality owing to a sudden change of the luminance, the luminance control time ΔT and the luminance reduction slope S can be set to be the same, regardless of the input luminance Lin of the each area detected as the luminance control area. Thus, the luminance control speed may be regularly controlled.

Figure 9:
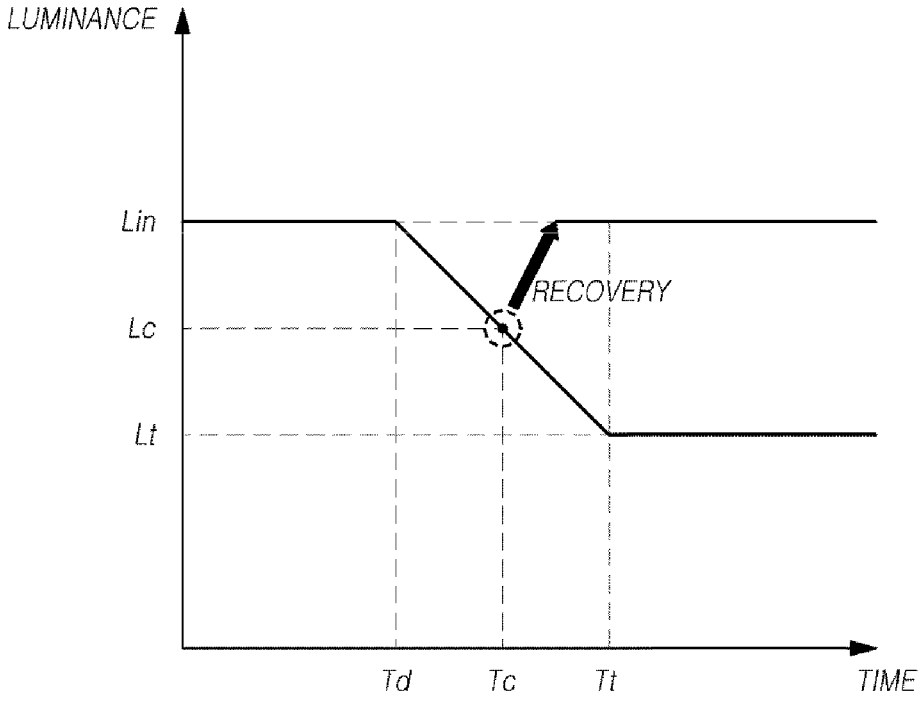
FIG. 9 illustrates a luminance control function of the display device according to an embodiment of the invention.

Next, FIG. 9 illustrates the luminance controlling unit 230 that starts the lowering of the luminance of the luminance control area detected by the luminance control area detecting unit 210, from the input luminance Lin, at the time point Td, based on the luminance control reference information set by the luminance control reference setting unit 220. While lowering the luminance, when the luminance of the area detected as the luminance control area becomes the target minimum luminance Lt included in the luminance control reference information at the time point Tt, the luminance controlling unit 230 does not lower the luminance of the area detected as the luminance control area and maintains the luminance of the area detected as the luminance control area as the target minimum luminance Lt. The luminance control reference information may basically include at least one of the target minimum luminance Lt and the maximum luminance reduction width ΔL, and selectively include at least one of the luminance reduction slope S and the luminance control time ΔT. Although the luminance of the area detected as the luminance control area is lowered, the luminance of the area detected as the luminance control area is not lowered beyond the target minimum luminance Lt, through the luminance control according to the luminance control reference information. Thus, image quality degradation owing to the excessive luminance reduction may be prevented.

The luminance control unit 230 starts the lowering of the luminance of the luminance control area detected by the luminance control area detecting unit 210, from the input luminance Lin, at the time point Td, based on the luminance control reference information set by the luminance control reference setting unit 220 (refer to FIG. 9). While lowering the luminance, when the corresponding area which has been detected as the luminance control area does not satisfy the luminance control area condition, the area which has been detected as the luminance control area is changed to a luminance non-control area. A luminance of the area changed to the luminance non-control area may be recovered from a luminance Lc at the time point Tc to the input luminance Lin.

Because, during the luminance control, when an afterimage occurrence characteristic of the area which has been detected as the luminance control area is changed (i.e., when the area which has been detected as the luminance control area is changed to the luminance non-control area where the possibility of the afterimage is low), the adaptive luminance control is processed, unnecessary luminance reduction may be prevented. Therefore, image quality degradation owing to the unnecessary luminance reduction may be prevented. Because, during the luminance control, when the afterimage occurrence characteristic of the area has been detected as the luminance control area is changed to the luminance non-control to prevent the unnecessary luminance reduction (i.e., to recover the controlled luminance to the input luminance Lin before the time point Tc when the luminance control area is changed to the luminance non-control area), the luminance of the area changed to the luminance non-control area may be recovered from the luminance of the time point Tc to the input luminance Lin.

Figure 10A:
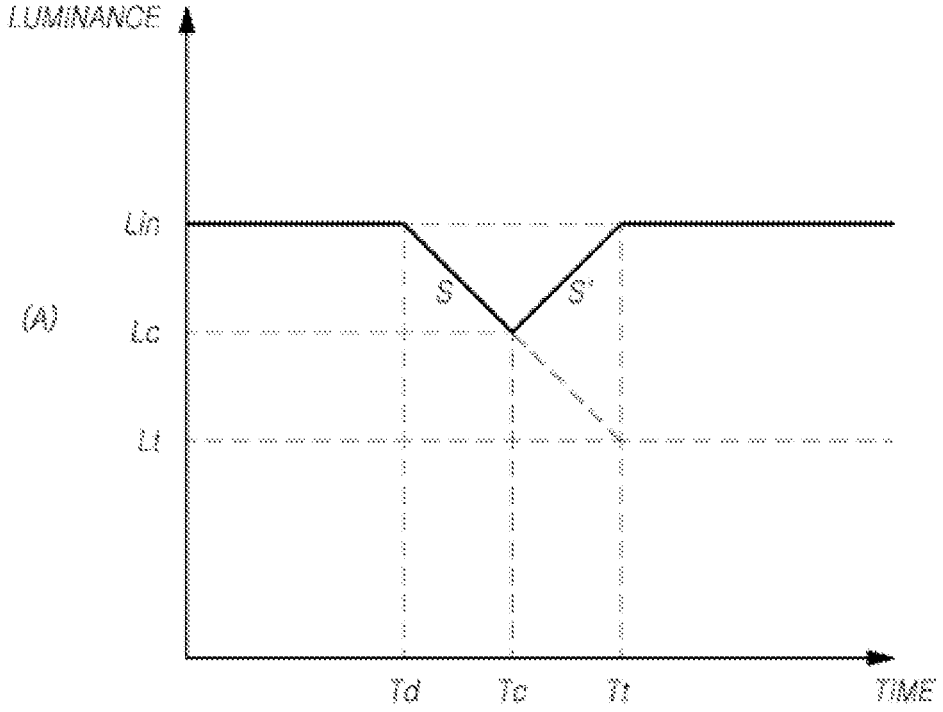
FIGS. 10A and 10B illustrate a luminance recovery scheme during a luminance control of the display according to an embodiment of the invention.
Figure 10B:
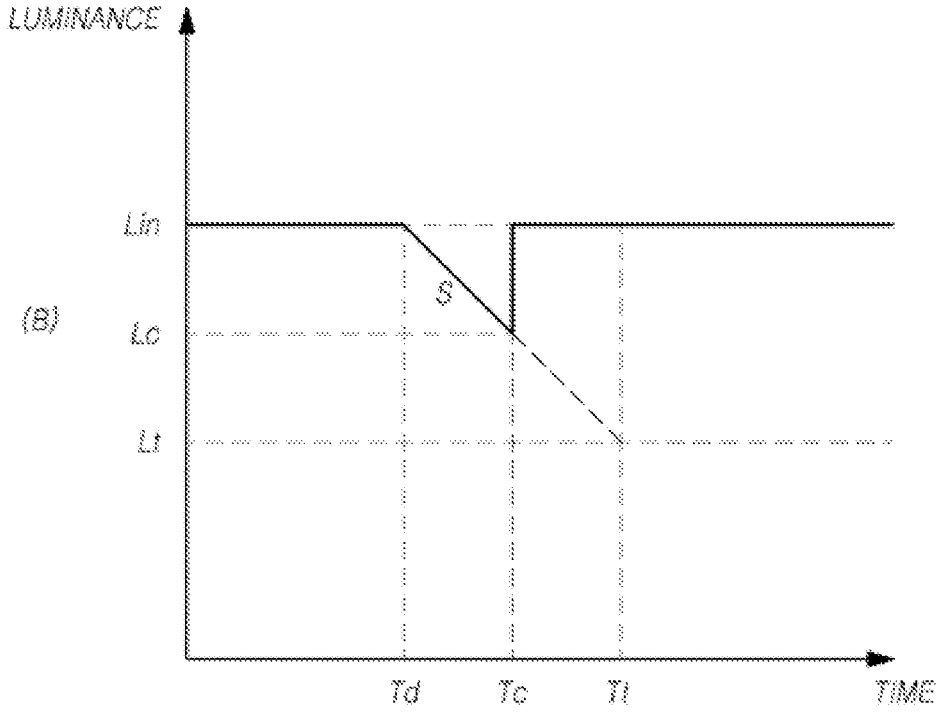

Next, FIGS. 10A and 10B illustrate that the luminance of the area changed to the luminance non-control area may be recovered from the luminance of the time point Tc to the input luminance Lin through a luminance increase slope S' corresponding to the luminance reduction slope S of the time point Tc. The luminance of the area changed to the luminance non-control area may be recovered from the luminance of the time point Tc to the input luminance Lin, through a luminance increase slope S' corresponding to the luminance reduction slope S of the time point Tc (refer to FIG. 10A), and may be recovered from the luminance of the time point Tc to the input luminance Lin immediately (refer to FIG. 10B).

As described above, the present embodiments can improve image quality by effectively preventing an afterimage phenomenon. Differential afterimage prevention is processed according to each area where the afterimage may occur. An afterimage phenomenon is effectively prevented to improve image quality through an adaptive luminance control. And, image quality is effectively improved by providing a differential and adaptive luminance control using various luminance control reference information.

While the technical spirit of the present invention has been exemplarily described with reference to the accompanying drawings, it will be understood by a person skilled in the art that the present invention may be varied and modified in various forms without departing from the scope of the present invention. Accordingly, the embodiments disclosed in the present invention are merely to not limit but describe the technical spirit of the present invention. Further, the scope of the technical spirit of the present invention is not limited by the embodiments. The scope of the present invention shall be construed on the basis of the accompanying claims in such a manner that all of the technical ideas included within the scope equivalent to the claims belong to the present invention.

What is claimed is:

1. A timing controller for a display device, the timing controller comprising:

a luminance control area detecting device configured to analyze image data and detect at least one candidate area of an active area of a display panel in the display device satisfying a luminance control area condition as a luminance control area;

a luminance control reference setting device configured to:

differentially set a target minimum luminance or a maximum luminance reduction width as luminance control reference information for the luminance control area, according to an input luminance of the at least one candidate area, set a higher input luminance of the at least one candidate area detected as the luminance control area, a lower target minimum luminance, or a bigger maximum luminance reduction width, or set a lower input luminance of the at least one candidate area detected as the luminance control area, a higher target minimum luminance, or a smaller maximum luminance reduction width, and set a luminance control time, which is a factor of a luminance control speed, as the luminance control reference information, wherein the luminance control time for the higher input luminance is set to be shorter, and the luminance control time for the lower input luminance is set to be longer; and a luminance controlling device configured to control a luminance of the luminance control area, based on the luminance control reference information.

2. The timing controller of claim 1, wherein the luminance control area corresponds to at least one area of the display device including at least one pixel area that consistently displays an object having an input luminance that is maintained within a predetermined luminance range according to a predetermined time.

3. The timing controller of claim 1, wherein the detected luminance control area corresponds to at least one area of the display device including at least one pixel area that consistently displays an object having an input luminance that is maintained within a predetermined luminance range according to a predetermined ratio.

4. The timing controller of claim 1, wherein an object displayed in the luminance control area on the screen is an image including at least one of a logo, date information, time information, weather information, channel information, contents-related information, broadcast program-related information, and subtitles.

5. The timing controller of claim 1, wherein the luminance control reference setting device is further configured to set a luminance reduction slope, which is a factor of a luminance control speed, as the luminance control reference information, according to the input luminance of the at least one candidate area detected as the luminance control area.

6. The timing controller of claim 5, wherein the luminance control reference setting device is further configured to set, based on a smaller luminance reduction slope, a higher input luminance of the detect at least one candidate area detected as the luminance control area, a bigger luminance reduction slope, and a lower input luminance of the at least one candidate area detected as the luminance control area.

7. The timing controller of claim 1, wherein the luminance controlling device is further configured to maintain a luminance of the luminance control area as a target minimum luminance, when the luminance of the luminance control area becomes the target minimum luminance included in the luminance control reference information, while reducing the luminance of the luminance control area based on the luminance control reference information.

8. The timing controller of claim 1, wherein the luminance controlling device is further configured to change the detected luminance control area into a luminance non-control area and recover a luminance of the luminance non-control area to an input luminance, when the detected luminance control area does not satisfy the luminance control area condition, while reducing the luminance of the detected luminance control area based on the luminance control reference information.

9. A display device comprising:

a plurality of data lines and a plurality of gate lines;

a data drive unit configured to drive the plurality of data lines;

a gate drive unit configured to sequentially drive the plurality of gate lines; and a timing controller configured to:

control the data drive unit and the gate drive unit, start a scan according to timing implemented in each frame of image data input to the timing controller, detect at least one candidate area of an active area of a display panel in the display device satisfying a luminance control area condition as a luminance control area, differentially set a target minimum luminance or a maximum luminance reduction width as luminance control reference information for the luminance control area, according to an input luminance of the at least one candidate area, set a higher input luminance of the at least one candidate area detected as the luminance control area, a lower target minimum luminance, or a bigger maximum luminance reduction width, or set a lower input luminance of the at least one candidate area detected as the luminance control area, a higher target minimum luminance, or a smaller maximum luminance reduction width, set a luminance control time, which is a factor of a luminance control speed, as the luminance control reference information, wherein the luminance control time for the higher input luminance is set to be shorter, and the luminance control time for the lower input luminance is set to be longer, and control a luminance of the luminance control area, based on the luminance control reference information.

* * * * *